United States Patent [19]

Schult

[11] Patent Number: 4,911,975

[45] Date of Patent: Mar. 27, 1990

[54] POLYMER BITUMEN WEB

[75] Inventor: Kurt Schult, Dorsten, Fed. Rep. of Germany

[73] Assignees: Dr. Kohl GmbH; CIE Dachbelag-und Bautenschutzmittel-Fabrik, both of Dorsten, Fed. Rep. of Germany

[21] Appl. No.: 181,868

[22] Filed: Apr. 15, 1988

[30] Foreign Application Priority Data

Apr. 16, 1987 [DE] Fed. Rep. of Germany ... 8705654[U]

[51] Int. Cl.[4] ..... B32B 7/00; B32B 27/00

[52] U.S. Cl. ..... 428/193; 428/167; 428/194; 428/215; 428/252; 428/291; 428/332; 428/339; 428/346; 428/355; 428/489

[58] Field of Search ..... 428/167, 252, 291, 489, 428/193, 194, 215, 332, 339, 346, 355

[56] References Cited

U.S. PATENT DOCUMENTS

| | | | |
|---|---|---|---|
| 4,107,375 | 8/1978 | Iwasaki | 428/291 |
| 4,291,086 | 9/1981 | Auten | 428/242 |
| 4,731,284 | 3/1988 | Hailer | 428/291 |

FOREIGN PATENT DOCUMENTS 1496197 12/1977 United Kingdom .

*Primary Examiner*—Marion C. McCamish
*Attorney, Agent, or Firm*—Herbert Dubno; Ronald Lianides

[57] ABSTRACT

A polymer bitumen web for roof covering or the like has a black polymer bitumen sealing layer on the underside of a fabric support and a cover layer which is light colored and preferably white on an upper surface of the support to reflect impinging solar radiation.

20 Claims, 1 Drawing Sheet

POLYMER BITUMEN WEB

FIELD OF THE INVENTION

My present invention relates to a polymer bitumen web, strip or band for the sealing of roofs, other surfaces of a structure and surfaces of any type which must be sealed against the penetration of moisture. More particularly, the invention relates to a polymer bitumen web which comprises a support of fabric, fleece or nonwoven fabric, fiber or the like and upon an underside of which a sealing layer is provided of black polymer bitumen.

BACKGROUND OF THE INVENTION

It is known to provide a polymer web which can be used for the sealing of roof surfaces and other surfaces of a structure against the penetration of water or moisture which has an upper sealing layer of black polymer bitumen in addition to a support of a woven or nonwoven fabric, fleece or fiber and a sealing surface on the underside.

To protect the upper surface, it is known to provide a broken rock or rock-fragment layer usually of schist or shale, the rockfragment layer or broken-rock covering tending to penetrate into at least the upper sealing layer and in many cases to weaken it.

A further disadvantage of this surface protection is the tendency of the rock-fragment layer to crack, spall or burst at the high temperatures applied in welding the web edges together.

Such high temperatures are necessary to weld edges of the strip together and assures bonding of the strips in an impervious manner.

The bursting of the rock-fragment layer, especially in overlap regions at which the seams are formed, may interfere with the formation of an effective seal.

In practice it is not possible to avoid the presence of the rock-fragment layer in the overlapping regions and the very presence of the rock-fragment layer at the interface also reduces the reliability of the seal or prevents the formation of a seal altogether.

Another drawback of earlier systems is the tendency, after the rock-fragment layer or shale layer has worn away by weathering of the upper sealing layer to undergo photochemical degradation, generally as a result of the sun's rays. This degradation sharply reduces the life of the roof covering.

It has been proposed to prevent this or to retard the photochemical degradation by providing a comparatively expensive gravel covering which is not possible in many cases on purely static grounds.

OBJECTS OF THE INVENTION

It is the principal object of the present invention to provide a polymer bitumen web, suitable for use as a roof covering and also as a moisture barrier or sealing layer for other structural surfaces, which can avoid the drawbacks of the earlier systems described and can provide a high-sealing efficiency together with a long usable life.

Another object of this invention is to provide a polymer bitumen sealing strip, sheet or band which can be easily applied to a surface, e.g. a roof to be sealed, which can be readily sealed to adjoining strips in a highly reliable manner and which does not suffer from the flaking of rack fragments nor require expensive gravel-protective layers.

SUMMARY OF THE INVENTION

These objects and others which will become apparent hereinafter are attained, in accordance with the invention, in a roof-covering web or a web of polymer bitumen capable of use for other sealing purposes which comprises the fiber-containing support, i.e. the support of woven or nonwoven fabric, fleece or intermatted fibers and filament, a layer of black polymer bitumen on the underside of the support and, as an upper layer on the upper side of the support, a cover layer of a light-colored material capable of highly reflecting incident solar radiation so that without the provision of an expensive gravel covering, the life of the polymer bitumen web, subject to weather and solar radiation is greatly increased.

In addition, the upper, light-colored cover layer should have a smooth surface which additionally increases useful life of the polymer bitumen web since it prevents accumulation of dust on the upper surface and encrustation which may result therefrom and may cause a tearing or lifting of the upper or cover layer.

The support preferably lies centrally of the thickness of the web while the upper cover layer, like the lower polymer bitumen layer, is formed as a sealing layer. The light-colored cover layer does not, by contrast with the upper surface of conventional polymer bitumen webs, require covering by a gravel layer or the like.

It is also possible in accordance with the invention to extend the support substantially to and into the cover layer so that there is no layer between the support and the cover layer and the cover layer can thus form a protective covering for the support. In this case, rather than have an additional layer or layers between the support and the cover layer, the support may lie directly beneath the comparatively thin protective layer.

In this embodiment, the raised or increased-thickness support protects the continuous and conventional sealing layer on the underside which can be thicker than usual whereas the light-colored cover layer forming the protective layer of the support can be significantly thinner.

The cover layer is preferably composed of white material which optimizes the barrier to penetration by external radiation into the web and through the latter.

Advantageously, while the polymer bitumen sealing layer can be a black polymer bitumen of conventional composition, the cover layer is preferably a polyolefin to which light-color or white pigments or additives have been admixed.

Preferably the lower sealing layer and the upper protective or cover layer can be bonded to the support, which may be preimpregnated to permit permanent bonding so that there can be no separation of the layers in use of the web.

The light color of the cover layer need not, of course, be white, since other pigments can be added to impart a red or green tint, for example, thereto.

The underside of the lower or sealing layer can be formed with an antibonding coating or by a material which is antibonding to allow a separating effect between the web and the roof surface, and passages can be formed in the underside of the web as well (see U.S. Pat. No. 4,731,284 issued Mar. 15, 1988).

The passage system for vapor can be downwardly open channels in the form of crossing grooves, for example, i.e. grooves extending parallel to the longitudinal edges of the web as well as grooves extending transversely of the web. Of course the passage system can be formed by providing the underside of the web as an array of projections so that passages are provided between the projections.

Advantageously, the polymer bitumen web is provided on its longitudinal and/or transverse edges as adhesive edge strips which are free from profiling so that two such edge strips can be laid together in an overlapping relationship without interference by profiling and sealed together.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
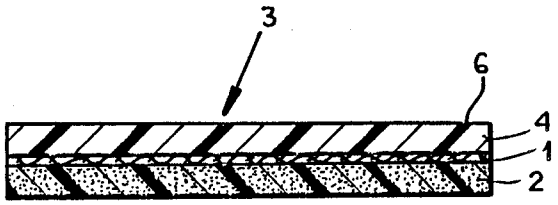
FIG. 1 is a section through a first embodiment of a polymer bitumen web in accordance with the invention.

FIG. 1 shows a polymer bitumen web 3 which can be used in the manner described in the above-identified patent as a roof covering, to cover decks and other structural elements with a water-impervious sheet, by overlapping edges of the web and fusing the overlapped edges together by heating with a torch or the like.

The thickness of the webs shown in the drawing has been exaggerated by comparison with other dimensions so as to clearly show the several layers of which the polymer bitumen strip is constituted.

The polymer bitumen web 3 comprises a carrier or support 1 of a fibrous material, namely, a woven or knitted fabric, a nonwoven mat or fleece or a mass of intertwined fibers such as a needled mat, which can be impregnated and partly penetrated by the polymer bitumen forming the sealing layer. In the embodiment of FIG. 1, the support layer 1 is located substantially midway of the thickness of the web 3. The underside of the web 3 is constituted by a sealing layer 2 of black polymer bitumen, e.g. of the composition of the sealing layer described in the above-identified patent and which can penetrate partly into the support layer 1 and is, of course, bonded to any polymer impregnating the latter or to the fibers themselves during the polymerization process. This sealing layer 2 is continuous, water tight and both gas and moisture impermeable.

On the upper side of the support layer 1 is a cover layer 4 of a light-colored material which, in the embodiment of FIG. 1, is shown as a relatively thick layer to serve as an additional sealing layer.

The thickness of the layer 4 can be substantially equal to the thickness of the lower layer 2. The cover layer 4 may be composed of polyethylene containing titanium dioxide or some other pigment suitable to impart a white color thereto or can be heavily pigmented polyurethane having a shiny white upper surface 6.

Figure 2:
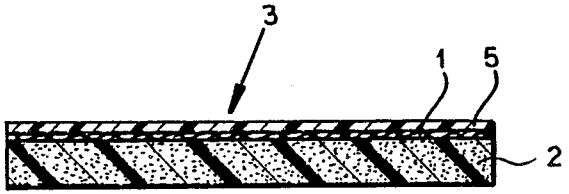
FIG. 2 is a cross sectional view of a second embodiment of the polymer bitumen web.

In the embodiment of FIG. 2, the support 1 is located near the upper surface of the web 3, the lower layer 2 being thicker as a result. In this case a relatively thin sheet 5 forms the cover layer 4 and serves as a protective covering for the support 1 which can be of the type described in connection with FIG. 1.

The sealing layer is thus formed only by the layer 2 and is not divided by the fabric or mat (fleece) layer 1. The layer 2, of course, can be a black polymer bitumen while the layer 5 may be polyethylene heavily filled with titanium dioxide or other white pigmenting material.

Figure 3:
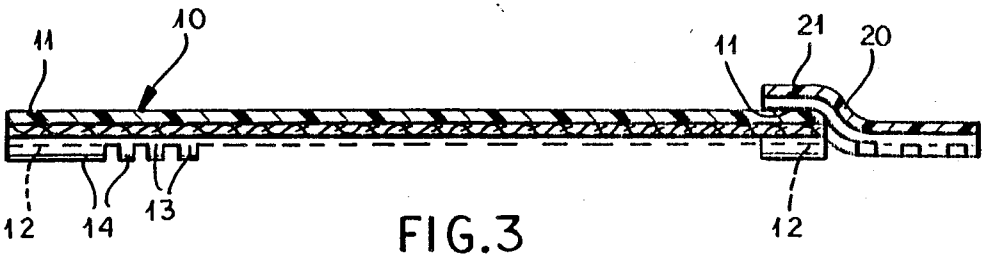
FIG. 3 is a yet another embodiment of the polymer bitumen web of the invention.

In FIG. 3 I have shown diagrammatically a web 10 which is sealed to a web 20 and which has sealing edges 11, 21 which are not profiled so that they can be overlapped and sealingly joined by heat.

The sealing edges may be provided with channels 12 if desired to provide intercommunication between passages defined by protuberances 13 on the underside of the web 10 in the sealing layer 2. The surfaces 14 which engage the structure surface to be protected are provided with antibonding or separating layers which prevent adhesion of the web to the structure or roof surfaces in accordance with the principles described in the aforementioned patent.

The zones or strips 11, 21 may be provided with adhesive coatings to promote bonding of adjacent webs together.

The lower sealing layer (2 in FIGS. 1, 2 and 3) has substantially the following composition:

about 40 to 60% by weight primary bitumen,
about 15 to 50% by weight polyolefin, and
about 10 to 20% by weight shale meal as a filler.

In the preferred or best-mode embodiment, the composition of this lower layer will be:

about 60% by weight primary bitumen,
about 30% by weight polyolefin, and
about 10% by weight shale meal as filler.

For the embodiment of FIG. 1, both the upper layer 4 and the lower layer 2 have a thickness of about 2 to 2.5 mm while in the embodiment of FIG. 2, the upper layer can have a thickness of about 0.5 to 1 mm while the lower layer 2 has a thickness of 3.5 to 4 mm. In all of the embodiments, the thickness of the support is about 0.5 to 1 mm. The support is preferably a polyester fleece, a glass fabric, a glass fiber fleece or a needled fleece of synthetic fibers, glass fibers or mixtures thereof.

The polyolefin referred to herein throughout can be polyethylene or polypropylene.

The cover layer 4 has in each case the preferred composition:

about 30 to 70% by weight polyolefin,
about 20 to 65% by weight glass meal, and
about 5 to 10% by weight coloring agent, generally an inorganic pigment.

In the preferred or best-mode embodiment, the cover layer has a composition of:

50% by weight polyolefin,
45% by weight glass meal, and
5% by weight pigment.

Alternatively and at lower cost the cover layer has the following composition:

45% by weight polyolefin,
45% by weight glass meal,
5% by weight pigment, and
5% by weight primary bitumen.

The pigments can be any of those which are generally used to cover bitumen and polymer systems and may be titanium dioxide for a white cover layer, chromium dioxide for a green cover layer and iron oxide for red to brown cover layers. It has been found to be advantageous to color the layers 2 in addition to the layer 4, preferably with the same color as that of the layer 4.

I claim:

1. A moisture barrier surfacing web for the sealing of roofs and other structural surfaces, comprising:

a fiber support selected from the group consisting of polyester fleece, glass fabric, glass fabric fleece, needled fleece of synthetic fibers, glass fiber and mixtures thereof;

a sealing layer of black polymer bitumen bonded to an underside of said support; and a cover layer bonded to the upper side of said support and consisting predominantly of polyolefins admixed with light color or white pigments highly reflective to incident sunlight.

2. The web defined in claim 1 wherein said support is located substantially midway of the thickness of the web and said cover layer constitutes a sealing layer of an upper side of said support.

3. The web defined in claim 2 wherein said sealing layer of polymer bitumen bonded to the underside of said support has a thickness of about 2 to 2.5 mm.

4. The web defined in claim 1 wherein said support is provided close to an upper part of said web and said cover layer forms a protective layer on said support.

5. The web defined in claim 4 wherein said thickness of said sealing layer of polymer bitumen bonded to the underside of said support is about 3.5 to 4 mm.

6. The web defined in claim 1 wherein said cover layer is composed of white material.

7. The web defined in claim 1 wherein said sealing layer of black polymer bitumen has substantially the following composition:

about 40 to 60% by weight primary bitumen,
about 15 to 50% by weight polyolefin, and
about 10 to 20% by weight of shale meal as a filler.

8. The web defined in claim 7 wherein the sealing layer of black polymer bitumen consists substantially of:

about 60% by weight primary bitumen,
about 30% by weight polyolefin, and
about 10% by weight of shale meal as said filler.

9. The web defined in claim 1 wherein said support is impregnated with a composition consisting substantially of:

about 70 to 90% by weight primary bitumen and
about 10 to 30% by weight polyolefin.

10. The web defined in claim 9 wherein said support has a thickness of about 0.5 to 1 mm.

11. The web defined in claim 1 wherein said cover layer has substantially the following composition:

about 30 to 70% by weight polyolefin,
about 20 to 65% by weight glass meal, and
about 5 to 10% by weight of a coloring agent.

12. The web defined in claim 11 wherein said cover layer has substantially the following composition:

about 50% by weight polyolefin,
about 45% by weight glass meal, and
about 5% by weight pigment.

13. The web defined in claim 11 wherein said cover layer has substantially the following composition:

about 45% by weight polyolefin,
about 45% by weight glass meal,
about 5% by weight pigment, and
about 5% by weight primary bitumen.

14. The web defined in claim 11 wherein said coloring agent is titanium dioxide pigment for a white cover layer, chromium dioxide pigment for a green cover layer and iron oxide for a red to brown colored cover layer.

15. The web defined in claim 11 wherein the thickness of said cover layer is about 2 to 2.5 mm.

16. The web defined in claim 11 wherein the thickness of said cover layer is about 0.5 to 1 mm.

17. The web defined in claim 1 wherein said sealing layer and said fiber support are colored with the same coloration as said cover layer.

18. The web defined in claim 1 wherein the cover and sealing layers are bonded to said fiber support and said fiber support is preimpregnated to bond to said sealing and cover layers.

19. The web defined in claim 1 wherein the underside of the sealing layer bonded to the underside of the support is provided as a vapor pressure equalizing structure with an antibonding character with respect to a support structure for the web.

20. The web defined in claim 1 wherein said web is formed with adhesive strips along edges thereof for bonding to an adjoining web.

* * * * *